US008585074B2

(12) United States Patent
Vailli

(10) Patent No.: US 8,585,074 B2
(45) Date of Patent: Nov. 19, 2013

(54) BOOT-ATTACHMENT DEVICE ON A SKI WITH SAFETY INTERFACE

(75) Inventor: Johan Vailli, Coublevie (FR)

(73) Assignee: Skis Rossignol, Saint-Jean-de-Moirans (FR)

( * ) Notice: Subject to any disclaimer, the term of this patent is extended or adjusted under 35 U.S.C. 154(b) by 88 days.

(21) Appl. No.: 13/242,342

(22) Filed: Sep. 23, 2011

(65) Prior Publication Data

US 2012/0074670 A1 Mar. 29, 2012

(30) Foreign Application Priority Data

Sep. 28, 2010 (FR) ..... 10 57798

(51) Int. Cl.
*A63C 5/00* (2006.01)

(52) U.S. Cl.
USPC ..... 280/613; 280/611; 280/617

(58) Field of Classification Search
USPC ..... 280/611, 617, 618, 602, 623, 613, 607, 280/616, 624
See application file for complete search history.

(56) References Cited

U.S. PATENT DOCUMENTS

| | | | | |
|---|---|---|---|---|
| 3,672,694 | A * | 6/1972 | Whittaker | 280/618 |
| 3,865,388 | A * | 2/1975 | Haldemann | 280/613 |
| 3,963,253 | A * | 6/1976 | Rieger | 280/616 |
| 5,265,901 | A * | 11/1993 | Gorza | 280/632 |
| 5,282,643 | A * | 2/1994 | Jungkind | 280/626 |
| 5,332,253 | A * | 7/1994 | Couderc et al. | 280/602 |
| 5,411,283 | A * | 5/1995 | Nowak et al. | 280/618 |
| 5,566,966 | A | 10/1996 | Couderc et al. | |
| 5,636,855 | A * | 6/1997 | Couderc et al. | 280/602 |
| 6,899,349 | B2 * | 5/2005 | Laughlin et al. | 280/624 |
| 2,095,853 | A1 | 8/2009 | Mercat et al. | |
| 1,810,727 | A1 | 10/2010 | Damiani et al. | |
| 2009/0212534 | A1 * | 8/2009 | Mercat et al. | 280/613 |

FOREIGN PATENT DOCUMENTS

| | | | |
|---|---|---|---|
| EP | 0765680 | A | 4/1997 |
| EP | 0968742 | B | 1/2004 |
| EP | 2095853 | A | 9/2009 |
| EP | 1810727 | B | 12/2009 |
| WO | WO 00/59588 | A | 10/2000 |

OTHER PUBLICATIONS

Search Report from French Patent Office for priority application 10 57798 dated Jul. 5, 2011.

* cited by examiner

*Primary Examiner* — Hau Phan
(74) *Attorney, Agent, or Firm* — Frommer Lawrence & Haug LLP; Ronald R. Santucci

(57) ABSTRACT

An arrangement for the disengagement of a boot-attachment element on a sliding board comprising at least one receiving element (1, 2) for receiving a boot-attachment element on a sliding board, the arrangement comprising an automatic disengagement device for releasing the boot from the at least one attachment element, the disengagement device comprising a strip (5) and/or several articulated link rods (31, 32) forming a mechanical disengagement device and a lock (6, 10, 11) making it possible to lock or activate the mechanical disengagement device, the mechanical disengagement device being connected to at least one receiving element (1, 2) for receiving a boot-attachment element on a sliding board in order to allow its movement beyond a certain force sustained by the receiving element (1, 2) when the mechanical disengagement device is active.

18 Claims, 6 Drawing Sheets

BOOT-ATTACHMENT DEVICE ON A SKI WITH SAFETY INTERFACE

This application claims priority benefits to French Patent Application No. 10 57798 filed Sep. 28, 2010, the disclosure of which is herein incorporated by reference.

The invention relates to an arrangement for the disengagement of a boot-attachment element for a sliding board, such as for example a toepiece or a heelpiece of a boot-attachment device on a ski. It also relates to a boot-attachment device as such, and a sliding board as such, including such an arrangement for disengagement.

BACKGROUND OF THE INVENTION

A boot-attachment device of a ski, also called ski binding, is designed to secure the skiboot of a skier to a ski. It comprises a front toepiece, also called front end stop, which makes it possible to immobilize the front of the boot and a rear heelpiece of which a jaw interacts with a rear protrusion of the sole of the skiboot. These two attachment elements for attaching a boot are furnished with an automatic disengagement mechanism which makes it possible to release the boot beyond a certain stress, in order to prevent injuries in the event of a fall for example.

Standards define maximum disengagement values that must not be exceeded for the automatic release of a boot in such a secure attachment device. According to the prior art, these disengagements are applied by the toepiece and/or the heelpiece via a mechanical means based on a spring which induces an automatic rotation of the jaws engaged with the boot under the effect of certain forces higher than a certain predefined threshold, in order to release the boot. However, in practice, it occurs that the effect of the disengagement spring alone is insufficient and many statistics show that improved bindings could reduce the number of injuries sustained by skiers. These conventional solutions of mechanical disengagement are notably not very effective in the event of a slow fall of a skier during which the forces transmitted to the attachment elements can remain below the provided disengagement threshold but extend over a long period.

DESCRIPTION OF THE PRIOR ART

Thus, documents EP968742, EP1810727 and EP2095853 describe solutions which comprise an additional disengagement device, in addition to the conventional spring-based mechanical means described above, which operates on the basis of an electronically controlled electric motor. These solutions are designed to release the boot in the event of a slow fall. However, they are either too complex because they rely on many components, and are difficult and expensive to implement, or they are fragile because they transmit high stresses to various components, or they are simply insufficiently effective.

SUMMARY OF THE INVENTION

Thus, there is a need for an improved disengagement solution to securely release a boot on a sliding board. More precisely, the invention seeks to achieve all or some of the following objects.

A first object of the present invention is to propose a disengagement solution for releasing a boot on a sliding board which allows the automatic release of the boot in the event of a slow fall.

A second object of the present invention is to propose a disengagement solution to release a boot on a sliding board, said solution being simple, compact, economical and reliable.

A third object of the present invention is to propose a disengagement solution making it possible to minimize the forces sustained by the elements comprising the disengagement mechanism.

Accordingly, the invention is based on an arrangement for the disengagement of a boot-attachment element on a sliding board comprising at least one receiving element for receiving a boot-attachment element on a sliding board, said arrangement comprising an automatic disengagement means for releasing the boot from the at least one attachment element, this means comprising a strip and/or several articulated link rods forming a mechanical disengagement means and a lock making it possible to lock or activate the mechanical disengagement means, the mechanical disengagement means being connected to at least one receiving element for receiving a boot-attachment element on a sliding board in order to allow its movement beyond a certain force sustained by the receiving element when the mechanical disengagement means is active.

The at least one receiving element may comprise a rod of which one end is connected to the mechanical disengagement means.

The mechanical disengagement means may comprise a strip which is positioned in a vertical or horizontal plane and which extends longitudinally.

The strip may comprise at least one immobilization post.

The mechanical disengagement means may comprise one end connected to a receiving element and another end connected to a fixed portion or to another receiving element.

The lock may comprise a control means for controlling an immobilization element resting on the strip and/or the link rods.

The lock may comprise a rotatable immobilizing lever comprising a surface resting on the mechanical disengagement means in the locked configuration; and a control means for controlling an immobilization element of the immobilizing lever.

The mechanical disengagement means may comprise two link rods connected together by a rotary spindle, the bearing surface being close to this rotary spindle.

The mechanical disengagement means may comprise a strip associated with at least one link rod.

The mechanical disengagement means may deform for a longitudinal force greater than a threshold of between 150 and 250 N when the mechanical disengagement means is active.

According to an advantageous embodiment, the mechanical disengagement means does not deform for a longitudinal force of less than 1000 N when the mechanical disengagement means is locked.

The arrangement may comprise a slow-fall detection means connected to a means for controlling the lock allowing automatic unlocking in the event of a slow fall.

The invention also relates to a boot-attachment device for a sliding board comprising at least one front or rear attachment element for attaching a boot and comprising a disengagement means for releasing the boot from the at least one front or rear attachment element beyond a force greater than a threshold, wherein the disengagement means comprises a strip and/or several articulated link rods forming a mechanical disengagement means and a lock making it possible to lock or activate the mechanical disengagement means, the mechanical disengagement means being connected to at least one attachment element.

The at least one front or rear attachment element for attaching a boot may comprise a second mechanical disengagement means for releasing the boot beyond a force greater than a second threshold of greater intensity.

The boot-attachment device for a sliding board may comprise a toepiece for immobilizing the front portion of a boot and a heelpiece for interacting with the rear portion of a boot, the toepiece and the heelpiece each comprising their disengagement means comprising at least one spring, and said device may comprise an arrangement as described above.

The invention also relates to a sliding board which comprises an arrangement for the disengagement of a boot-attachment element as described above.

DESCRIPTION OF THE DRAWINGS

These objects, features and advantages of the present invention will be explained in detail in the following description of particular embodiments made in a nonlimiting manner with respect to the attached figures amongst which.

DESCRIPTION OF THE PREFERRED EMBODIMENTS

Figure 1:
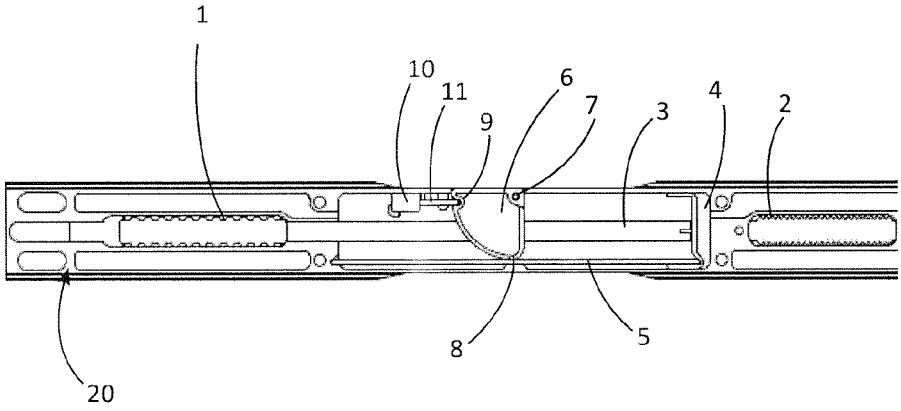
FIG. 1 represents a view from below of an arrangement for the disengagement of a boot-attachment element for a sliding board in the locked configuration according to a first embodiment of the invention.

The invention will be illustrated in the context of a boot-attachment device on a ski corresponding to an alpine binding comprising a toepiece and a heelpiece. It could however be implemented for the attachment of any boot-attachment element on any sliding board, including a snowboard for example, according to any other attachment principle.

In order to make the following description easier, the longitudinal direction will be used for the lengthwise direction of the boot-attachment arrangement, that is to say the direction of the boot when it is attached, from back to front, the transverse direction for the horizontal direction perpendicular to the lengthwise direction. The vertical direction is perpendicular to the other two directions and oriented upward.

According to the first embodiment of the invention illustrated in FIGS. 1 to 4, the arrangement for receiving the boot-attachment device on a ski comprises two receiving elements 1, 2 for attaching the toepiece and the heelpiece. These two receiving elements 1, 2 take the form of a plate comprising two parallel series of teeth, arranged on a rail 20, as is particularly visible in FIG. 1. These series of teeth extend in the longitudinal direction and can allow the adjustable securing of the toepiece and of the heelpiece on the ski in order to adapt to various boot sizes. For this, the toepiece and the heelpiece comprise a complementary toothed portion in their bottom portion, formed by a biting part not shown.

Moreover, the receiving element 1 is mounted so as to be free to slide longitudinally within the rail 20 and comprises a rod 3 which extends in the longitudinal direction to a toepiece 4.

According to one essential element of the invention, the arrangement also comprises a disengagement means making it possible to release a boot.

This disengagement means first of all comprises a mechanical disengagement means, formed by a strip 5 extending longitudinally and positioned in a vertical plane, of which a first end is attached to the rail 20 and the second end is resting on the toepiece 4.

The disengagement means also comprises a lock formed by an immobilizing lever 6 that can rotate about an axis 7 and comprises a surface 8 which rests in a central portion of the strip 5 in a locked configuration, thus preventing it from bending. Furthermore, the lock comprises a control means 10 of the electromagnet or piezoelectric activator type, which acts on an immobilization element 11 which interacts with a hollow portion 9 of the immobilizing lever 6 so as to keep it in the locked position by preventing its rotation about the axis 7 in a first position. The control means 10 makes it possible to modify the position of the immobilization element 11 as will be explained below. As a note, in this embodiment, the second receiving element 2, for the toepiece or the heelpiece, is independent of the disengagement means.

Figure 2:
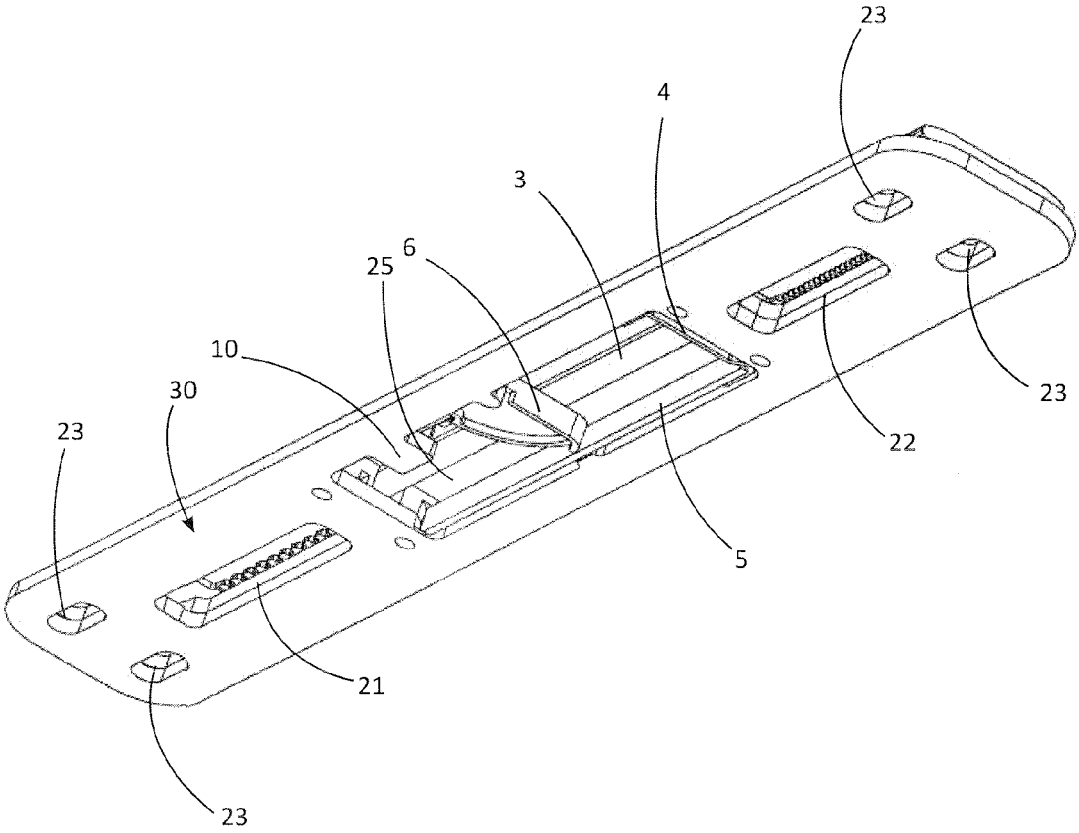
FIG. 2 represents a view in perspective from below of the arrangement for the disengagement of a boot-attachment element for a sliding board according to the first embodiment of the invention.

FIG. 2 shows a base 30 in a view from below. Four openings 23 can be seen in each corner of the base 30, which openings are designed for attachment elements to pass through, such as screws for example, for attaching the base 30 to a ski. Moreover, the base comprises two openings 21, 22 that are stretched out in the longitudinal direction in order to receive the biting parts not shown originating from the toepiece and from the heelpiece, designed to bite onto the receiving elements 1, 2. Finally, the base has a central opening 25 in which the disengagement means is placed.

Figure 3:
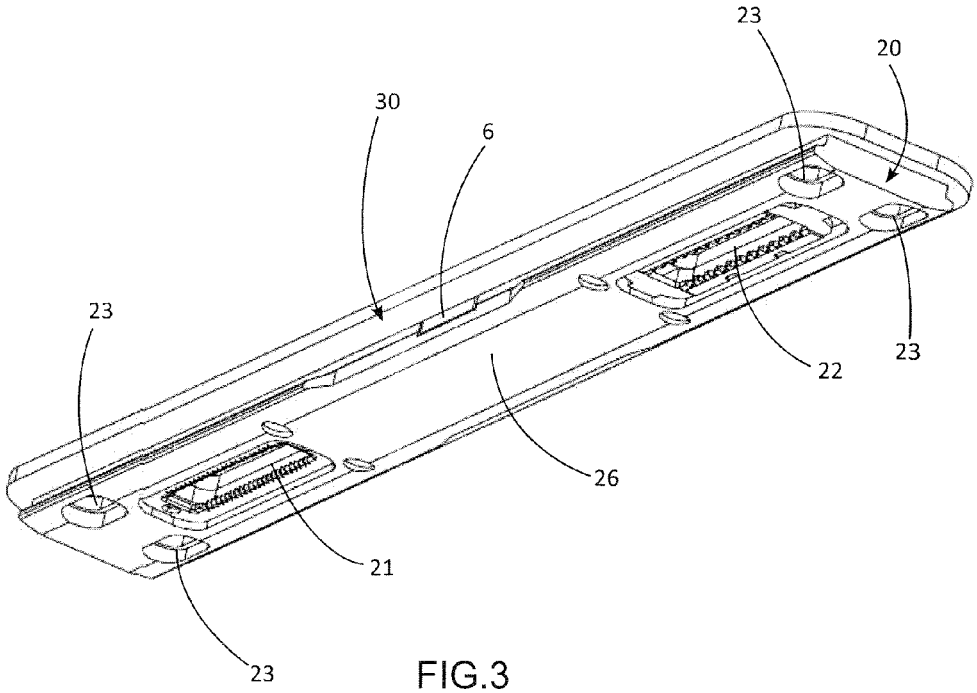
FIG. 3 represents a view in perspective from above of the arrangement for the disengagement of a boot-attachment element for a sliding board according to the first embodiment of the invention.

FIG. 3 shows the rail 20 mounted fixedly on the base 30, itself designed for an attachment to the top surface of a ski. The arrangement for the disengagement of an attachment element is thus placed in the thickness formed by the base and the rail. As a variant, the arrangement could be directly arranged on the surface of the ski, with no intermediate base or rail. In this FIG. 3 seen from above, the openings 23 can be seen that are provided for its attachment to a ski, and the two openings 21, 22 for receiving the toepiece and the heelpiece. The central portion 26 comprising the disengagement means is closed in order to protect this mechanism.

The operation of this arrangement will now be explained.

The disengagement means first of all comprises a means for detecting a slow fall of a skier, not shown, which can be any means, notably a means amongst those known in the prior art, the invention not being related to this particular means. For example, the detection means may be based on the measurement and analysis of the level of longitudinal force and the duration of this force on the toepiece or the heelpiece as a function of time and/or on the measurement of acceleration. When this means detects a slow fall of the skier, corresponding to a force that is weak but of long duration, it controls the actuation of the control means 10 which acts on the immobilization element 11 in order to release the immobilizing lever 6. Following this action, the disengagement means is then in an unlocked configuration, in which it is active. On the other hand, when the force is considerable or when it is weak but of short duration, the disengagement means is kept in its locked configuration. As a note, if the force sustained is very great, it is possible to exceed the bending threshold of the two portions of the strip 5 distributed on either side of the surface 8 of the immobilizing lever 6 and thus to obtain the disengagement of the attachment device. The disengagement means thus behaves like a means with two disengagement levels allowing a disengagement in the event of a slow fall and a disengagement in the event of a violent fall. These two levels can be predetermined by choosing the geometry of the disengagement means depending on the desired behavior.

Figure 4:
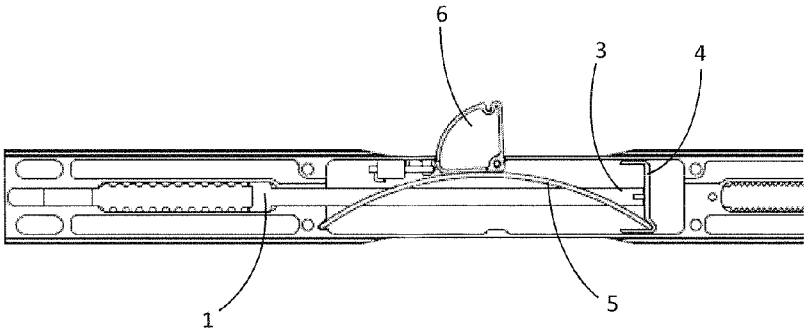
FIG. 4 represents a view from below of the arrangement for the disengagement of a boot-attachment element for a sliding board in the disengaged configuration according to the first embodiment of the invention.

In the unlocked configuration of the disengagement means, when a longitudinal force is applied to the toepiece or the heelpiece, it is transmitted to the retaining element 1 and then to the strip 5 via the rod 3 and the toepiece 4: when this force is above a certain threshold, corresponding for example to a case of a slow fall of the skier, the strip 5 bends while forming a curve extending transversely, reaching the configuration shown in FIG. 4. This bending of the strip provides a degree of freedom to the receiving element 1, and hence to the toepiece or the heelpiece, which is capable of moving in translation in the longitudinal direction and in particular away from the toepiece or the heelpiece, which it does under the force transmitted by the toepiece or the heelpiece. This movement causes the movement of the toepiece or the heelpiece in translation of the same amplitude, which allows the boot to be released. In parallel, the bending of the strip 5 automatically rotates the immobilizing lever 6, which makes a rotation of a quarter turn about its vertical axis 7 until it reaches the configuration shown in FIG. 4.

The strip 5 is naturally chosen so that its bending occurs beyond a threshold chosen to correspond to the minimum force sustained in the event of a slow fall of the skier. For this, it is advantageous to choose this threshold in the range between 150 and 250 N. The strip 5 may be made of glass fibers, have a length of between 140 and 220 mm, a width of approximately 8 mm, and a thickness of between 2 and 4 mm. Naturally, the strip could, as a variant, be made of another material, such as carbon or steel, while adapting its dimensions in order to achieve the performance mentioned above. Moreover, the lock can be very simple and not very sturdy because it sustains very weak forces: specifically, the strip does not transmit much force in the transverse direction. The overall architecture can be chosen so that the two portions of strip distributed on either side of the surface 8 of the immobilizing lever withstand a very considerable force applied to the strip 5, preventing any bending up to forces of less than 1000 N.

As a note, the solution has the advantage of reducing the high forces applied to the strip to a much weaker transverse force transmitted to the immobilizing lever 6 and the immobilization element 11. If the locking/unlocking is applied by an electronic means, a weak power is sufficient, which is very advantageous. Moreover, the immobilization element 11 receives a force that is weaker still because of its interaction by a rotary movement of the immobilizing lever 6 with the latter. As a variant, the immobilization means could come into direct contact with the strip, with no intermediate immobilizing lever.

After release of the disengagement means, the immobilizing lever 6 is positioned laterally outside the arrangement, which allows the skier to easily see that the device is unlocked and not operational. Before its next use, he must reposition it in its initial locked configuration. For this, it is sufficient to manually turn the immobilizing lever 6 in the reverse direction by a quarter turn by overcoming the relatively weak transverse force applied by the strip 5, until it again interacts with the lock 10 in order to return to the configuration of FIGS. 1 to 3.

Figure 5:
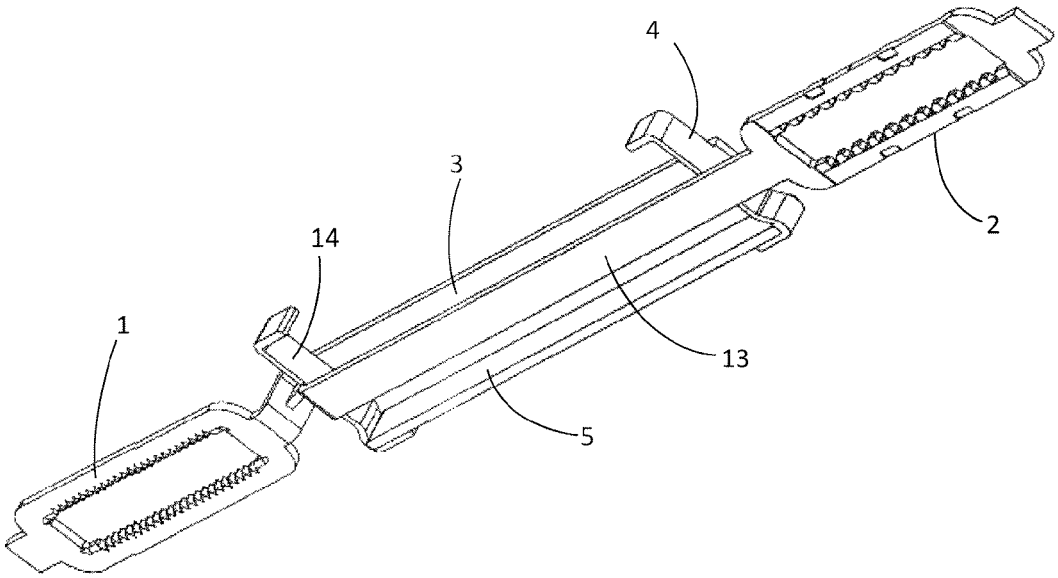
FIG. 5 represents a view in perspective of the arrangement for the disengagement of a boot-attachment element for a sliding board in the locked configuration according to a first variant of the first embodiment of the invention.

FIG. 5 illustrates a first variant embodiment of the first embodiment of the invention in which the two receiving elements 1, 2 of the toepiece and the heelpiece are both mounted so as to be able to move longitudinally. For a reason of simplification, the base 30, the rail 20 and the lock are not shown in this figure. The second receiving element 2 also comprises a rod 13 interacting with a toepiece 14 positioned on the second end of the strip 5, of which the first end remains connected to the rod 3 associated with the first receiving element 1. In this variant, the two rods 3, 13 are superposed on one another, the two toepieces 4, 14 being positioned between the two rods. When the strip 5 bends, the two receiving elements 1, 2 of the toepiece and of the heelpiece both become free to move in longitudinal translation in order to allow the release of a boot.

Figure 6:
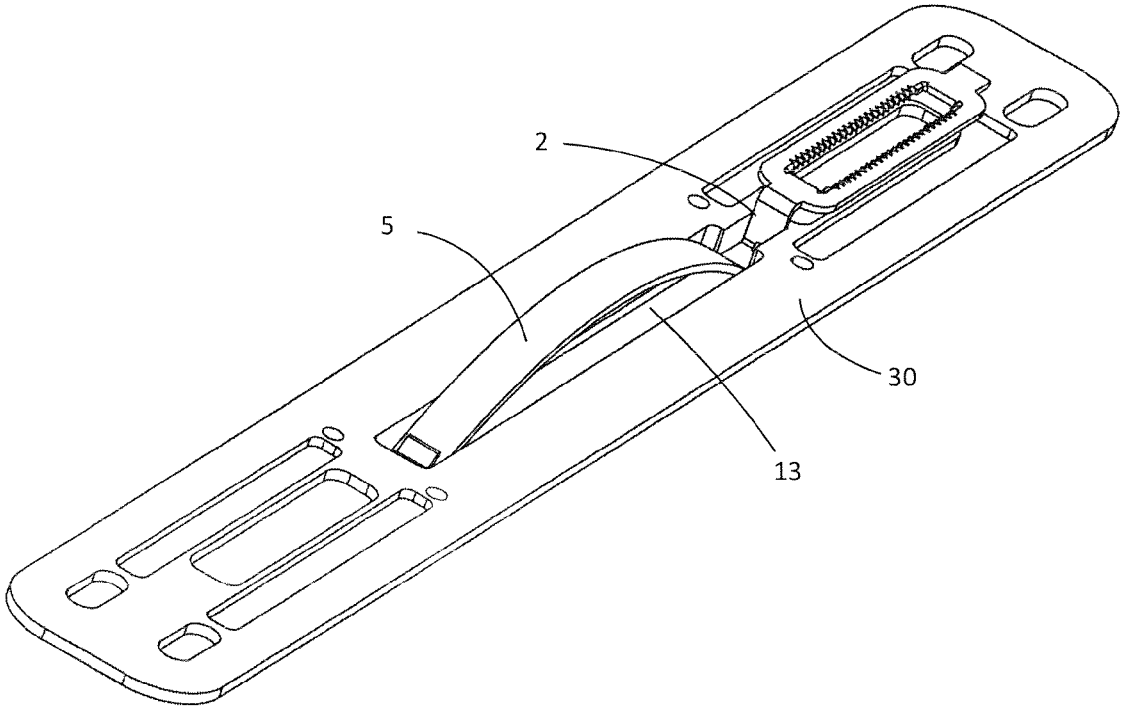
FIG. 6 represents a view in perspective from above of the arrangement for the disengagement of a boot-attachment element for a sliding board in the disengaged configuration according to a second variant of the first embodiment of the invention.

FIG. 6 illustrates a variant of the preceding variant, in which the strip is positioned on a horizontal and not a vertical plane, in the rest position. Thus, in the bent position as shown, the strip follows a curvature in a vertical direction and not in a transverse direction and will occupy the space remaining between the base and the sole of the boot. This solution makes possible in an equivalent manner the disengagement of the boot-attachment device and the release of the boot.

Figure 7:
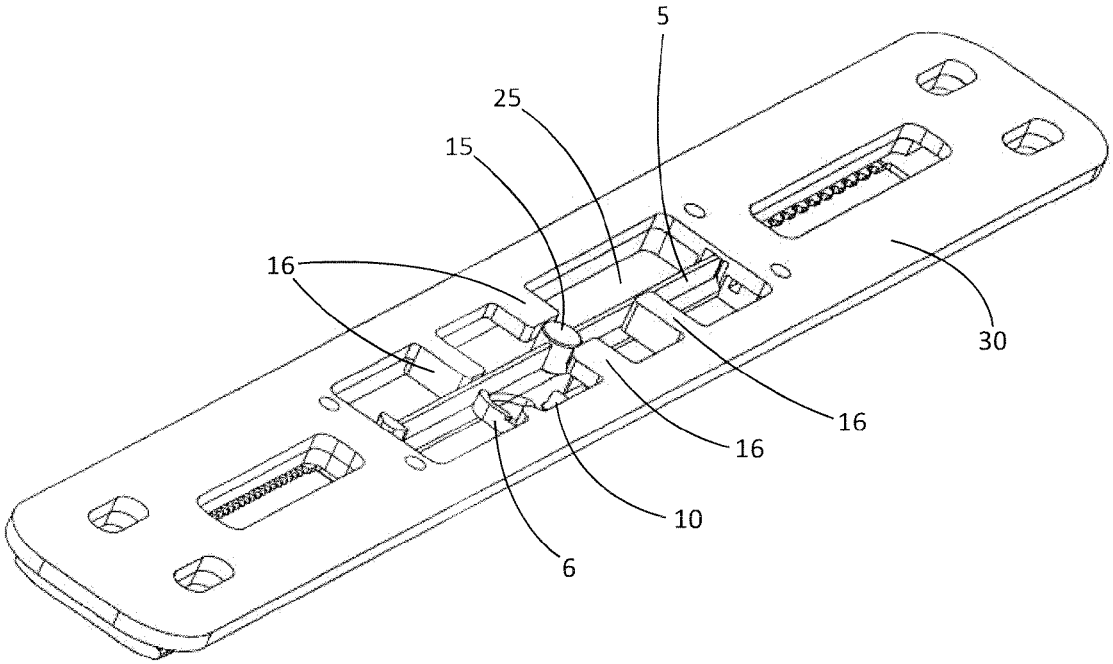
FIG. 7 represents a view in perspective from below of the arrangement for the disengagement of a boot-attachment element for a sliding board in the locked configuration according to a third variant of the first embodiment of the invention.
Figure 8:
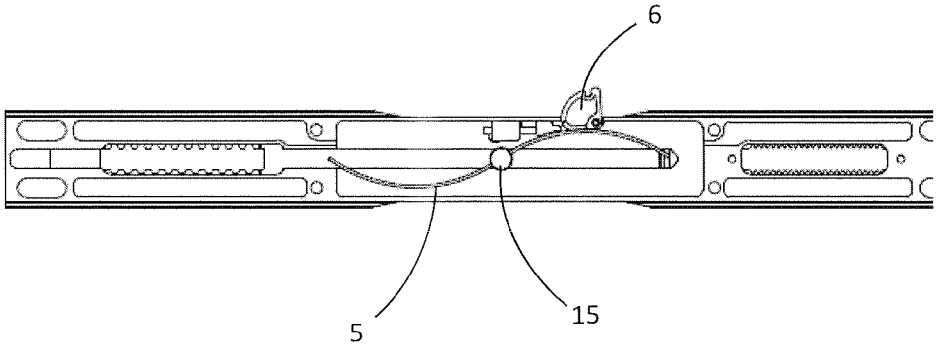
FIG. 8 represents a view from below of the arrangement for the disengagement of a boot-attachment element for a sliding board in the disengaged configuration according to the third variant of the first embodiment of the invention.

FIGS. 7 and 8 show a third variant embodiment of the invention in which a fixed immobilization post 15 is positioned on the strip 5. In this variant, each portion of the strip distributed on either side of the post can bend when the disengagement means is unlocked. Various transverse toepieces 16 are arranged within the opening 25 of the base 30 and come into contact with one face of the strip 5 in order to orient its bending toward the other face. The disengagement means still comprises a lock acting on an immobilizing lever 6 as described above. In the bent position as illustrated in FIG. 8, the strip 5 has two transverse movements of opposite direction about the post 15. This embodiment has the advantage of allowing a centered positioning of the strip, of removing any friction force that it could sustain. As a variant, the position of the post could be adjustable, in order to make it possible to modify the bending properties of the strip 5 and to thus adjust the disengagement threshold. According to another variant, several posts could be placed on the strip.

Figure 9:
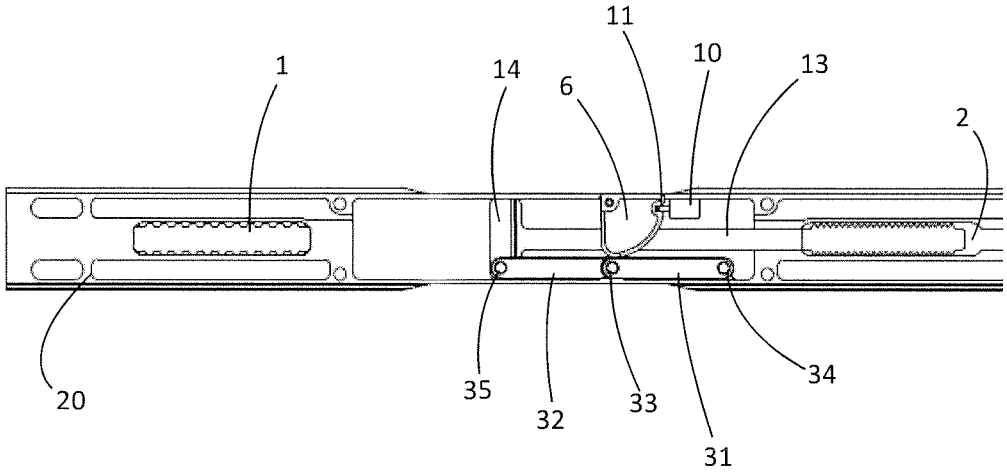
FIG. 9 represents a view from below of an arrangement for the disengagement of a boot-attachment element for a sliding board in the locked configuration according to a second embodiment of the invention.
Figure 10:
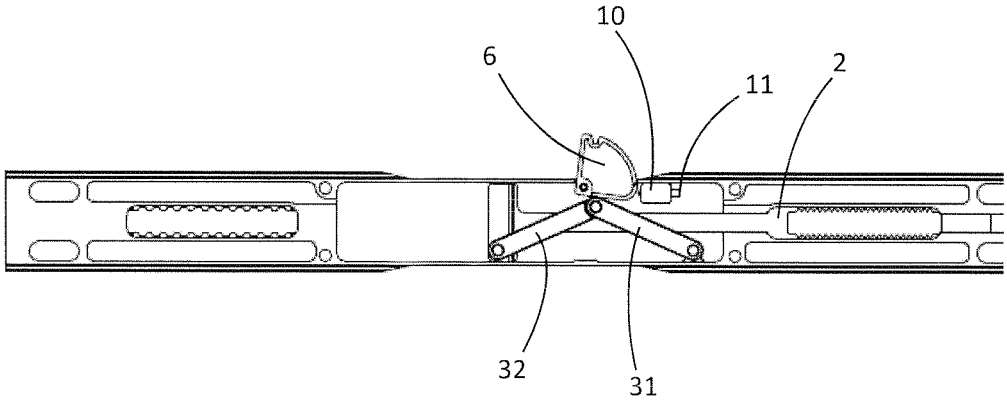
FIG. 10 represents a view from below of the arrangement for the disengagement of a boot-attachment element for a sliding board in the disengaged configuration according to the second embodiment of the invention.

FIGS. 9 and 10 illustrate a second embodiment of the invention which differs mainly from the first embodiment in that the strip is replaced by a mechanical disengagement means formed by two link rods 31, 32 that are substantially aligned and extend in the longitudinal direction in the locked configuration illustrated in FIG. 9. According to the embodiment shown, the second receiving element 2 of the toepiece or the heelpiece has a rod 13 extending longitudinally up to an toepiece 14. The first link rod 31 is attached by a rotary spindle 34 to the rail 20 while the second link rod 32 is attached to the movable toepiece 14 by a rotary spindle 35. The two link rods 31, 32 are connected together by a rotary spindle 33. The three spindles 33, 34, 35 are substantially aligned. According to an advantageous embodiment, the spindle 33 is slightly offset toward the center in order to make it easier for the link rods to fold. The lock formed by the immobilizing lever 6 and the immobilization element 11 is as in the first embodiment. The bearing surface 8 of the immobilizing lever 6 is on the rotary spindle 33 for connection between the two link rods 31, 32.

The operation of the disengagement means thus obtained is similar to that of the first embodiment. When the disengagement means is unlocked, the two link rods 31, 32 move sideways beyond a certain threshold of longitudinal force applied. The architecture is defined so that the two link rods move in the event of a slow fall of a skier. FIG. 10 illustrates the position of the two link rods 31, 32 in the disengaged configuration.

Figure 11:
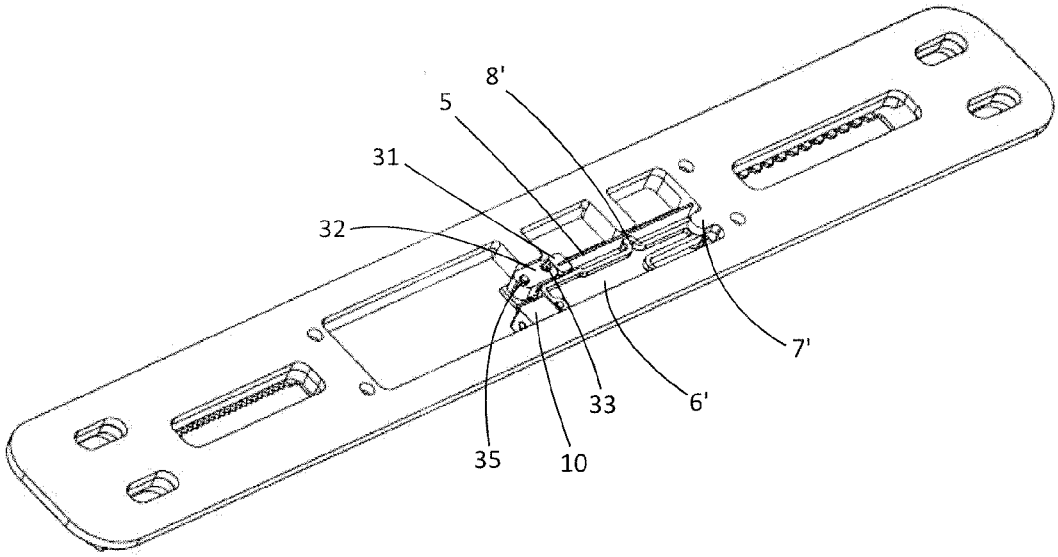
FIG. 11 represents a view in perspective from below of an arrangement for the disengagement of a boot-attachment element for a sliding board in the locked configuration according to a third embodiment of the invention.
Figure 12:
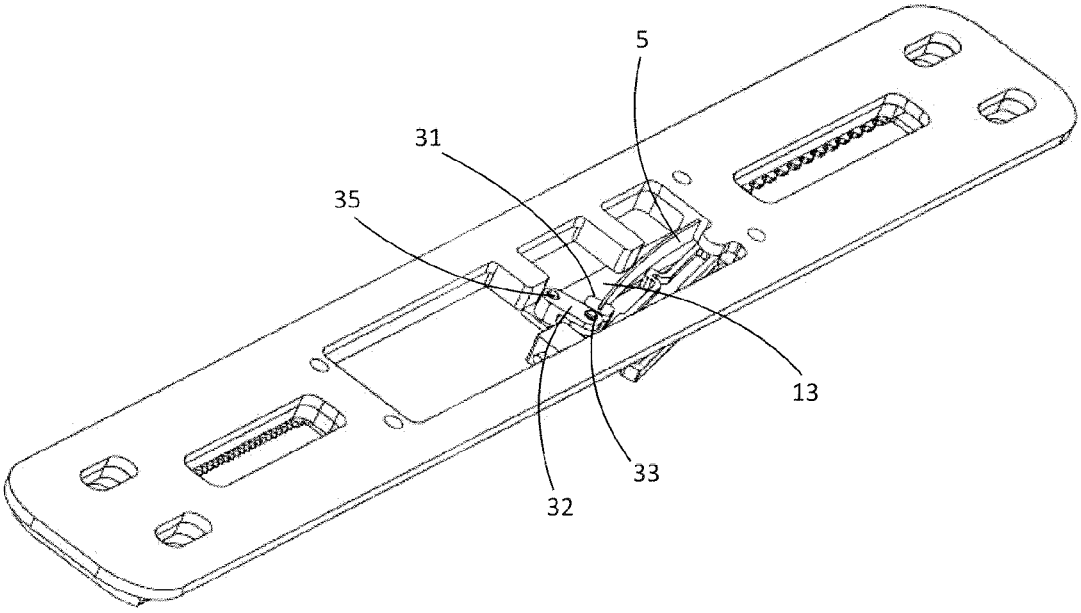
FIG. 12 represents a view in perspective from below of the arrangement for the disengagement of a boot-attachment element for a sliding board in the disengaged configuration according to the third embodiment of the invention.

FIGS. 11 and 12 illustrate a third embodiment of the invention which combines the previous two embodiments. Specifically, the disengagement means comprises a mechanical disengagement means comprising a strip 5 and two link rods 31, 32. The strip 5 comprises a first end resting on the base 30 and a second end attached to the first link rod 31. The latter is connected to a second link rod 32 via a rotary spindle 33. The second link rod has one end connected to the rod 13 by a rotary spindle 35, itself connected to the receiving element 2 of the toepiece or of the heelpiece.

The disengagement means also comprises a lock comprising an immobilizing lever 6' comprising a bearing surface 8' coming into contact with the strip 5 and being able to rotate about a spindle 7'. A control means 10 makes it possible to immobilize or not the rotation of the immobilizing lever 6'. In the disengaged position, illustrated in FIG. 12, the two link rods 31, 32 are no longer aligned, as in the previous embodiment, and the strip 5 is curved.

This third embodiment has the advantage of combining the properties of the link rods and of an elastic strip. The strip deforms in section. Initially, it begins to bend toward the lock, then pulls the link rod in a second stage, and then bends. This solution takes up little space in both directions, the longitudinal and transverse directions.

Following the previous description, it seems evident that other embodiments can be conceived, notably by combining the various variants described above. Moreover, other architectures could be envisaged without departing from the context of the invention. Notably, the arrangement has been provided within a base designed for an attachment on a sliding board. As a variant, it could be directly incorporated into the structure of the sliding board without using a base. Moreover, the various components participating in the disengagement could take other forms. For example, the receiving elements of a boot-retention element could take a simplified form without a toothed portion. The mechanical disengagement means could be different, comprising for example more than two link rods. The translational movement of a receiving element for receiving the toepiece or the heelpiece could have various amplitudes. Advantageously, a relatively small amplitude, of the order of 9 mm, will be chosen, which is sufficient to release a boot. If the two receiving elements are free to move, each can do so to a reduced amplitude of 4.5 mm to obtain an equivalent result. Moreover, the arrangement described allows movements in longitudinal translation: however, it could be equivalent to provide movements in different directions or of a different nature, such as rotations of certain components.

The arrangement descried above is therefore particularly suitable for the disengagement of a boot-attachment device, that is to say inducing the automatic release of a boot from the attachment device. This solution is suitable for an attachment device comprising a front retention element and a rear retention element as in the case of a ski. Thus, this arrangement is particularly suitable for being combined with the existing toepiece and heelpiece for the purpose of representing an additional disengagement means, being added to the conventional, spring-based mechanical disengagement means already provided in the toepiece and heelpiece. This additional disengagement means will then be provided to alleviate the deficiencies of the conventional disengagement means, notably in order to obtain the disengagement of the attachment device in the event of a slow fall as described above. In such a case, the attachment device will therefore have a first disengagement means reacting beyond a first threshold of sustained force of high intensity but of short duration, corresponding to the existing disengagement standards and a second disengagement means reacting beyond a second distinct threshold of force sustained of lower intensity but of longer duration.

As a variant, however, the disengagement means according to the invention could be used in isolation or as a replacement for the conventional disengagement means and could then be used to obtain the disengagement of an attachment device in other situations than a slow fall. Notably, the two levels of disengagement explained above could thus be exploited. In such a case, the disengagement threshold values could be adapted and could differ from the range given above.

Moreover, the same arrangement could be used for any other sliding board than a ski, or in association with a single front or rear means for retaining a boot.

The invention claimed is:

1. An arrangement for the disengagement of a boot-attachment element on a sliding board comprising at least one receiving element (1, 2) for receiving a boot-attachment element on the sliding board, said arrangement comprising an automatic mechanical disengagement means for releasing the boot front the at least one attachment element, and a lock (6, 10, 11) to lock or activate the mechanical disengagement means, wherein when the mechanical disengagement means is active, a strip (5), connected to the receiving element through a mechanical connection, is deformed when the strip receives a force beyond a certain threshold, this force being sustained by the receiving element (1, 2) and transmitted to the strip through the mechanical connection.

2. The arrangement as claimed in claim 1, wherein the at least one receiving element (1; 2) comprises a rod (3; 13) of which one end is connected to the mechanical disengagement means and abuts one end of the strip.

3. The arrangement as claimed in claim 1, wherein the strip is positioned in a vertical or horizontal plane and which extends longitudinally.

4. The arrangement as claimed in claim 3, wherein the strip (5) comprises at least one immobilization post (15).

5. The arrangement as claimed in claim 1, wherein the mechanical disengagement means comprises one end connected to one of the at least one receiving elements (1; 2) and another end connected to a fixed portion or to another receiving element (2; 1).

6. The arrangement as claimed in claim 1, wherein the lock comprises a control means (10) for controlling an immobilization element (11) resting on the strip (5).

7. The arrangement as claimed in claim 1, wherein the lock comprises a rotatable immobilizing lever (6; 6') comprising a surface (8; 8') resting on the mechanical disengagement means in the locked configuration, and a control means (10) for controlling an immobilization element (11) of the immobilizing lever (6; 6').

8. The arrangement as claimed claim 1, wherein the strip is associated with at least one link rod (31, 32).

9. The arrangement as claimed in claim 1, wherein the strip deforms for a longitudinal force greater than a threshold of between 150 and 250 N when the mechanical disengagement means is active.

10. The arrangement as claimed in claim 1, wherein the strip does not deform for a longitudinal force of less than 1000 N when the mechanical disengagement means is locked.

11. The arrangement as claimed in claim 1, wherein said arrangement comprises a slow-fall detection means connected to a means for controlling the lock allowing automatic unlocking in the event of a slow fall.

12. A sliding board comprising an arrangement for the disengagement of a boot-attachment element as claimed in claim 1.

13. The arrangement as claimed in claim 1, wherein the strip is deformed when the strip receives a longitudinal force beyond a certain threshold.

14. The arrangement as claimed in claim 1, wherein the two receiving elements are movably mounted and cooperate respectively with the two ends of the strip.

15. The arrangement as claimed in claim 1, wherein the lock comprises a surface that rests in a central portion of the strip, and a control means for controlling the configuration locked or active of the mechanical disengagement means.

16. The arrangement as claimed in claim 1, wherein the end of the strip is connected to a rod, so that the strip begins to bend in a first stage, then pulls the rod in a second stage, when the mechanical disengagement means is active and when the strip receives a three beyond a certain threshold.

17. An arrangement for the disengagement of a boot-attachment element on a sliding board comprising at least one receiving element (1, 2) for receiving a boot-attachment element on a sliding board, said arrangement comprising an automatic mechanical disengagement means for releasing the boot from the at least one attachment element and a lock (6, 10, 11) to lock or activate the mechanical disengagement means, wherein when the mechanical disengagement means is not locked, several articulated link rods and a strip, connected to the receiving element through a mechanical connection, are moved (or deformed) when they receive a force beyond a certain threshold, this force being sustained by the receiving element and transmitted to the articulated link rods and to the strip through the mechanical connection.

18. An arrangement for the disengagement of a boot-attachment element on a sliding board comprising at least one receiving element (1, 2) for receiving a boot-attachment element on the sliding board, said arrangement comprising an automatic mechanical disengagement means for releasing the boot from the at least one attachment element, this means comprising a strip (5) and/or at least two articulated link, rods (31, 32) forming a mechanical disengagement means and a lock (6, 10, 11) making it possible to lock or activate the mechanical disengagement means, the mechanical disengagement means being connected to at least one receiving element (1, 2) for receiving a boot-attachment element on a sliding board in order to allow movement of the mechanical disengagement means beyond a certain force sustained by the receiving element (1, 2) when the mechanical disengagement means is active, the lock locking the mechanical disengagement means when no fail is detected by a slow-fall detection means.

* * * * *